US005347983A

United States Patent [19]

Shimek

[11] Patent Number: 5,347,983

[45] Date of Patent: Sep. 20, 1994

[54] DRAFT HOOD ATTACHMENT DEVICE

[76] Inventor: Ronald J. Shimek, 6665 West Hwy. 13, Savage, Minn. 55378

[21] Appl. No.: 36,956

[22] Filed: Mar. 25, 1993

[51] Int. Cl.[5] ..... F24B 1/188

[52] U.S. Cl. ..... 126/529; 126/301; 126/303; 126/307 A; 126/65

[58] Field of Search ..... 126/301, 303, 307 A, 126/512, 528, 529, 523, 531, 65, 66, 299 R

[56] References Cited

U.S. PATENT DOCUMENTS

| | | | |
|---|---|---|---|
| 506,205 | 10/1893 | Call et al. | 126/303 |
| 3,842,821 | 10/1974 | Juris | 126/512 |
| 5,119,799 | 6/1992 | Cowan | 126/65 |
| 5,191,877 | 3/1993 | Shimek et al. | 126/515 |

*Primary Examiner*—Carroll B. Dority
*Attorney, Agent, or Firm*—John B. Sowell

[57] ABSTRACT

A novel draft hood for mounting on top of a gas conversion unit to form an adaptor and coupler between the gas conversion unit and a chimney includes a box structure having a guide flange and a plurality of positioning flanges thereon. A down draft diverter is installed inside of the box structure juxtaposed the exhaust outlet in the top of the draft hood. A novel spring alignment means including control rod are inserted through the top of the draft hood and employed as a positioning and aligning device maneuverable from the inside of the combustion chamber of the gas conversion unit and employed to apply a spring force to the draft hood which couples it to the gas conversion unit.

9 Claims, 3 Drawing Sheets

DRAFT HOOD ATTACHMENT DEVICE

BACKGROUND OF THE INVENTION

1. Related Inventions

The present application is an improvement of our U.S. application Ser. No. 07/751,510 filed Aug. 29, 1991, now U.S. Pat. No. 5,191,877 for and "INSERTABLE GAS CONVERSION UNIT."

2. Field of the Invention

The present invention relates to integrated, pre-fabricated gas fireplace conversion units of the type that are adapted to be installed in existing woodburning, masonry fireplace enclosures or inside of existing pre-fabricated wood fireplace boxes.

3. Description of the Prior Art

The latest Clean Air Act mandates pollution standards for woodburning fireplaces and stoves. In addition to the Federal Clean Air standards that become more stringent and difficult to meet over a period of years, state and local area codes have become and are becoming even more stringent than the Federal law which is now defined in the Safety and Environmental Standards Act set forth in EPA Phase II 1991. These numerous standards that are promulgated cannot be met by most existing woodburning fireplaces and woodburning stoves. The owner of such fireplaces and stoves now number in the tens of millions, and are being faced with not using their fireplaces or buying new gas burning fireplaces or buying a gas insert unit which will fit into the fireplaces, and which will meet the newly promulgated standards.

In our co-pending U.S. application Ser. No. 07/751,510 there is shown and described a pre-fabricated gas fireplace insert unit or conversion kit which may be inserted into old or new conventional masonry fireplaces and may also be inserted in numerous pre-fabricated woodburning stoves which have the proper opening in the front. This gas fireplace insert unit is self-contained and may be inserted into numerous pre-fabricated woodburning fireplaces as well as existing or new masonry fireplaces which have the proper opening. However, a problem exists in attempting to place a large optimum size box gas conversion unit in an existing woodburning fireplace box or in a masonry fireplace. Such pre-fabricated woodburning fireplaces and masonry fireplaces are not equipped with down draft diverters which are required by Underwriters specifications and building codes to prevent a sudden down draft of air from extinguishing the gas flame of the gas conversion unit. If the down draft diverter is placed inside of the combustion chamber of the gas conversion unit, it not only diminishes the size of combustion chamber area, but it often visible and unattractive when seen through the gas doors of the gas conversion unit. In our co-pending U.S. application 07/751,510, U.S. Pat. No. 5,191,877, a novel down draft diverter coupler is described that connects the top of the gas conversion unit to a flexible liner in a chimney as the gas conversion unit is being placed in an existing fireplace enclosure. When clearance on the top of the gas conversion unit becomes small that it denies access to the installer's hands or a tool that can be visually manipulated, it becomes difficult or nearly impossible to make the sliding connection of the draft converter coupler to the top of the gas conversion unit.

Accordingly, it would be extremely desirable to provide a novel improve draft diverter coupler in the form of a draft hood attachment which can be connected to the top of the gas conversion unit in the blind area after it is inserted into an existing woodburning fireplace conversion.

SUMMARY OF THE INVENTION

It is a primary object of the present invention to provide a novel draft hood attachment device for attaching to the top of a gas fireplace conversion unit.

It is another primary object of the present invention to provide a novel draft hood attachment unit that is adapted to be attached to the top of a gas fireplace conversion unit after the conversion unit is completely installed in a fireplace enclosure.

It is another primary object of the present invention to provide a novel draft hood attachment device which is connectable to the top of a gas conversion unit from inside the combustion chamber of the gas conversion unit without tools.

It is another primary object of the present invention to provide a novel draft hood attachment unit which is self-aligning when connected to the top of a gas conversion unit by spring tension after the gas conversion unit is installed in a fireplace enclosure.

It is another primary object of the present invention to provide a novel draft hood attachment unit which comprises a down draft diverter in a substantially rectangular box and a spring attachment device for connecting the box to the top of the gas conversion unit.

It is another primary object of the present invention to provide a novel draft hood attachment device having a down draft diverter and an exhaust gas diverter in a rectangular box which mounts on top of a gas conversion unit.

According to these and other objects of the present invention, there is provided a draft hood attachment device for mounting on top of a gas conversion unit after the gas conversion unit is installed in the woodburning fireplace enclosure. The draft hood attachment device comprises a rectangular box having a guide flange on one edge and a plurality of positioning flanges on the attachment edges. The draft hood box is provided with an exhaust inlet which is offset from the exhaust outlet, and a down draft diverter located between the inlet and the outlet. The draft hood box is also provided with a spring attachment device which is actuated from inside the combustion chamber of the gas conversion unit, and aligns and connects the draft hood attachment unit and exhaust stack to the top of the gas conversion unit.

DESCRIPTION OF THE PREFERRED EMBODIMENT

Figure 1:
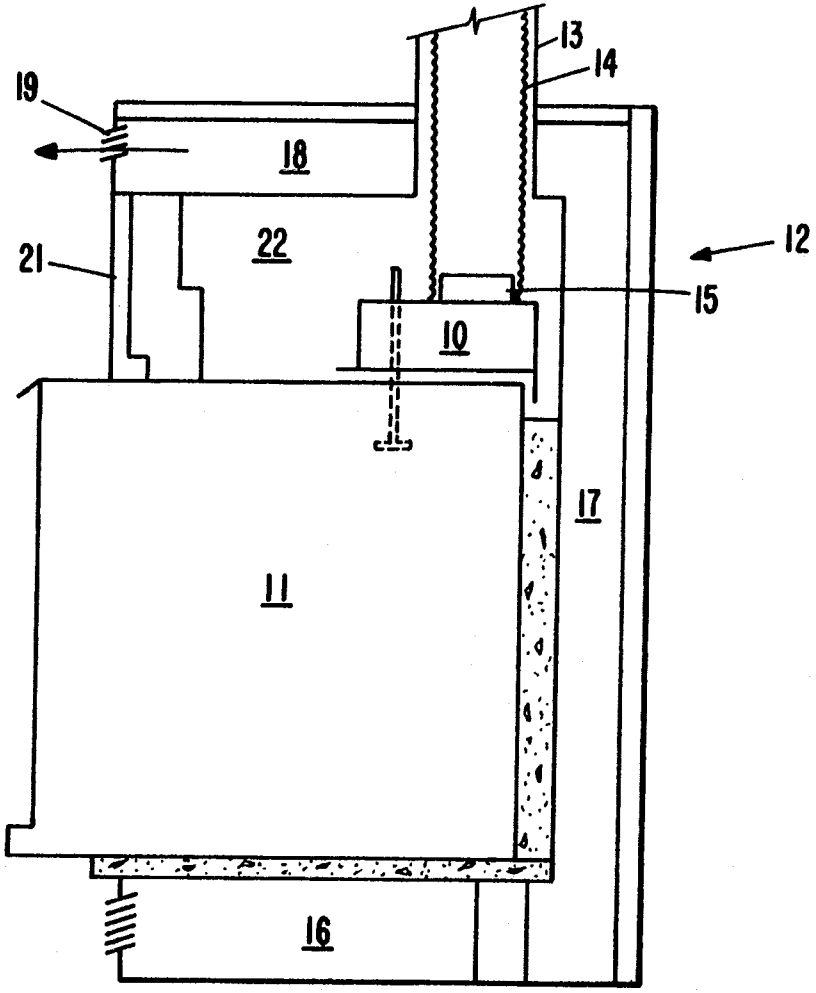
FIG. 1 is a schematic drawing in cross-section of a side elevation of the novel draft hood attachment device mounted on a gas conversion unit which is installed in a pre-fabricated woodburning fireplace enclosure.

Refer now to FIG. 1 showing a schematic drawing in cross-section of the novel draft hood attachment device mounted on top of a gas conversion unit 11 which is installed in a typical pre-fabricated woodburning fireplace enclosure 12. The woodburning fireplace 12 is shown provided with an exhaust stack 13 into which a flexible liner 14 has been installed and connected to the annular collar 15 of the draft hood 10. The existing fireplace enclosure 12 typically is provided with a heat exchanger which comprises a lower plenum 16, a rear plenum 17, and top plenum 18, which exhausts warm air out of the top grill 19. Such heat exchanger are sometimes provided with blowers which may be left in place and used to supplement the heat exchanger in the gas conversion unit 11. The pre-fabricated woodburning fireplace 12 is shown provided with a front panel 21 which extends from the heat exchanger down to the top of the gas conversion unit 11, thus providing a blind area 22 into which the draft hood attachment unit 10 must be connected to the top of the gas conversion unit 11 without the ability to observe what is taking place in the blind area or even to insert a proper alignment tool therein.

Figure 2:
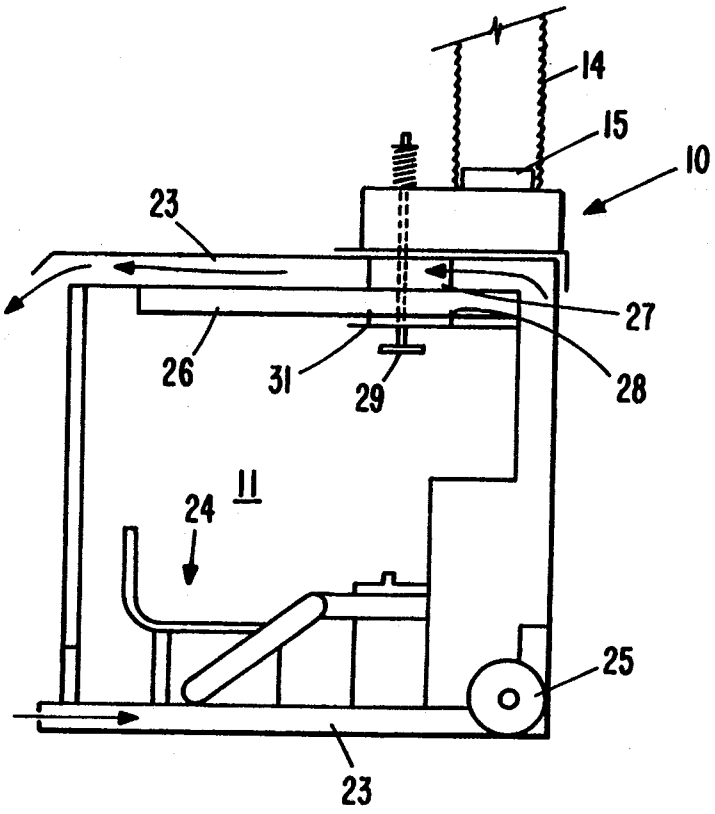
FIG. 2 is a more detailed schematic drawing cross-section of the gas conversion unit and the novel draft hood attachment device.

Refer now to FIG. 2 showing a more detailed schematic drawing of the gas conversion unit 11 and the present invention draft hood adaptor device 10 mounted thereon. In the preferred embodiment gas conversion unit 11, a heat exchanger 23 surrounds the bottom, back, and top of the combustion chamber and burner system 24, thus increasing the thermal efficiency of the gas conversion unit. The blower 25 in the gas conversion unit may be operated manually or controlled by a remote thermostat (not shown). The gas conversion unit 11 is provided with a horizontal baffle plate 26 which is open at the side edges and causes the exhaust gas to be diverted to the sides of the combustion chamber before moving horizontally to enter the exhaust outlet 27 of the conversion unit 11. A hole is provided in the baffle plate 26 to permit the T-bar 29 to pass into the combustion chamber. As will be explained in greater detail hereinafter, the T-bar 29 may be manually reached from inside the combustion chamber of the conversion unit 11 and pulled down against a spring tensioning device so that the T-bar 29 may be released to clamp the cover plate 31 in place and to close the hole or opening 28 as will be explained hereinafter.

Figure 3:
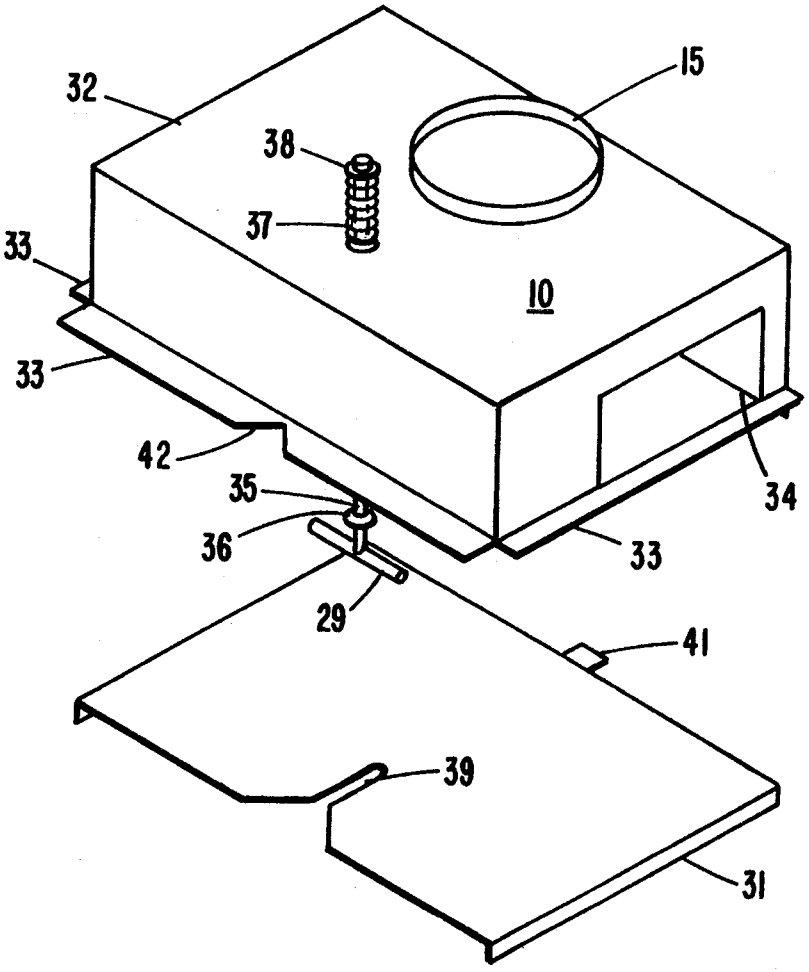
FIG. 3 is an enlarged isometric drawing of a preferred embodiment draft hood attachment device in an upright position.

Refer now to FIG. 3 showing an enlarged isometric drawing of the preferred embodiment draft hood attachment device 10 which comprises a substantially rectangular box 32 having a plurality of positioning flanges 33 which mount flush against the top of the conversion unit 11 and an alignment flange 34 adapted to abut against the back vertical wall of the conversion unit 11.

T-bar 29 is shown having a vertical connecting rod 35, having a fixed washer or flange 36 mounted thereon. A compression spring 37 is mounted co-axially surrounding connecting rod 35 and is held in compression by a washer 38. The preferred mode of connecting the draft hood attachment device 10 to the top of the gas conversion unit 11 is to align the T-bar 29 through the exhaust outlet 27 without the spring 37 being compressed. The installer then reaches up through the hole 28 and exhaust outlet 27 to grasp the handle of the T-bar 29. The spring 37 is then compressed by pulling down on the T-bar with the cover plate now in place over the hole 28. Then the T-bar is positioned into the groove 39 and released so that the washer 36 and spring 37 hold the cover plate 31 over the hole 28. The T-bar is also used to urge the alignment flange 34 against the rear vertical wall of the gas conversion unit 11. A tab 41 is provided on plate 31 and fits in a slot (not shown) to assure a tight fit of the cover plate 31. Further, an alignment groove 42 is provided on the forward positioning flange 33 which cooperates with an alignment pin on the top of the conversion unit 11.

Figure 4:
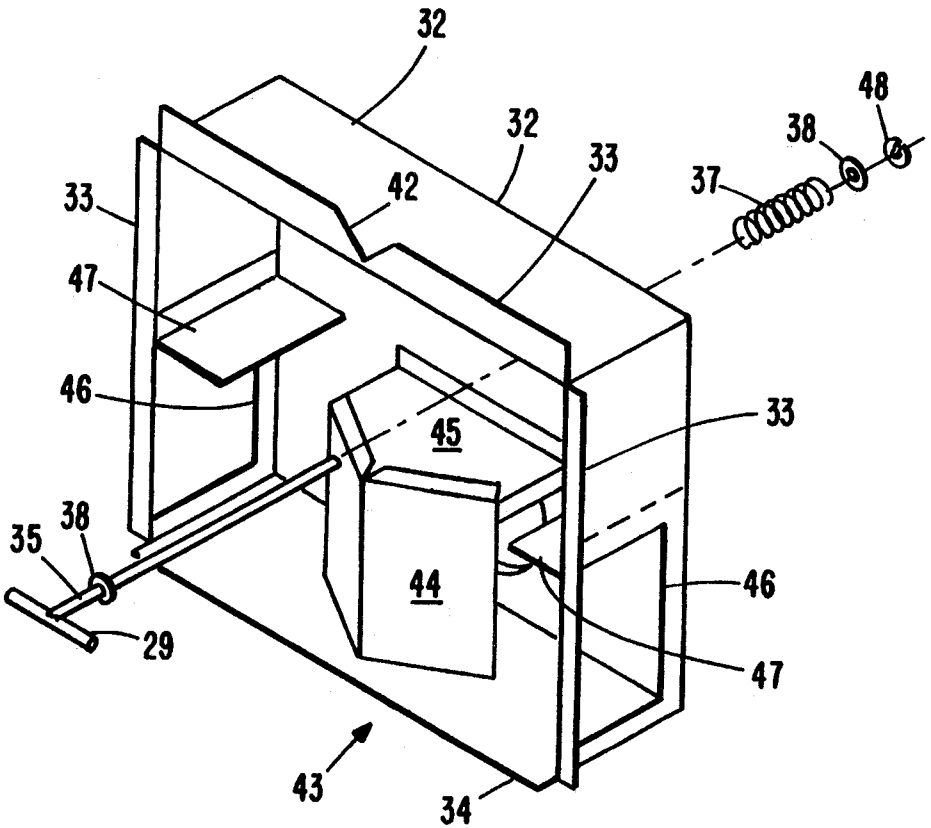
FIG. 4 is an enlarged isometric drawing of the draft hood attachment device of FIG. 3 tilted on its side to show the down draft diverter and exhaust gas diverter.

Refer now to FIG. 4 showing an enlarged isometric drawing of the draft hood attachment device tilted on its side to expose a down draft diverter 43. The down draft diverter preferably is made from formed sheet metal and comprises a V-shaped plate 44 connected to a L-shaped support plate 45 which is tack welded to the inside of the box 32. When a down draft of air occurs in the chimney it passes through the collar 15 and is diverted sideways by the diverter plate 44. The down draft force may then pass sideways through the down draft apertures 46, which dissipates the down draft pressure in the large volume or dead air space which surrounds the gas insert unit 11. Thus the down draft pressure is never passed directly into the combustion chamber of the gas conversion unit, which could cause the gas flame of the burner system to be extinguished. When the exhaust gas from the burner system 24 passes around the horizontal baffle 26 and enters into the exhaust outlet 27, it enters into the space of the box 32 above the down draft diverter 43 and is diverted by the L-shaped diverter plates 47 so that it passes above diverter plate 44 and into the flexible liner 14. Thus the exhaust gas path is diverted horizontally in the draft hood attachment unit as well as above the baffle plate 27. The T-bar 29 is shown with the spring 37, washer 38, and a connector clip 48 in an exploded view for greater detail.

Figure 5:
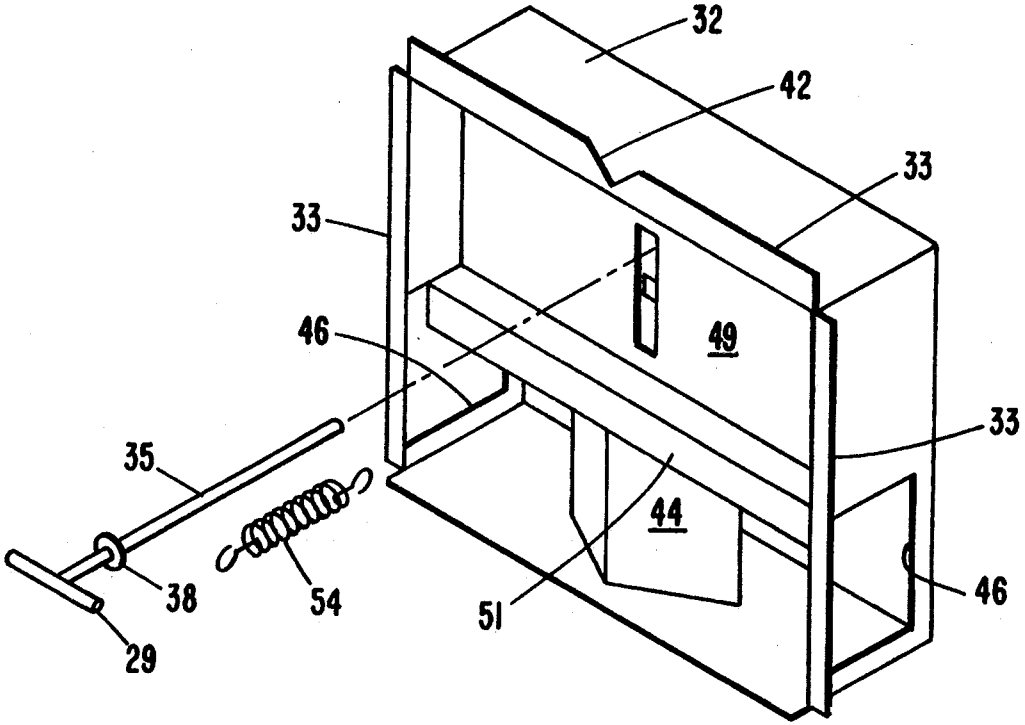
FIG. 5 is an enlarged isometric drawing of the novel draft hood attachment device shown in FIG. 4 showing a modified exhaust gas diverter.

Refer now to FIG. 5 showing an enlarged isometric drawing of the novel draft hood 10 with a modified exhaust gas diverter 49 which replaces the L-shaped exhaust gas diverter plates 47. The diverter plate 49 is shown extending across the inside of the box 32 and is tack welded to the side walls. The diverter plate 49 is aligned above the exhaust outlet 27, thus causes the exhaust gas to be dispersed both horizontally and sideways across the L-shaped channel 51 before passing around the diverter plate 44 and entering the liner 14. The alignment flange 34 and the positioning flanges 33 and other elements of the draft hood attachment device 10 operate the same as those explained hereinbefore with reference to FIG. 4 and do not require further explanation.

Figure 6:
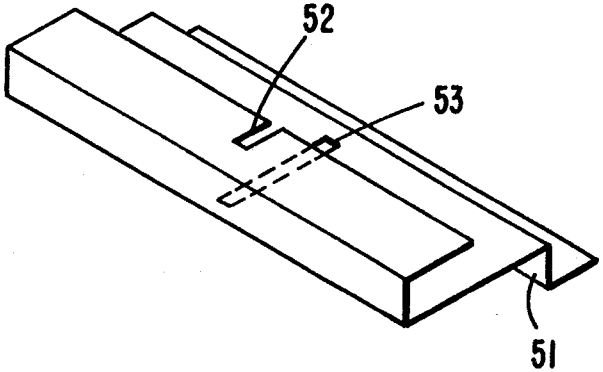
FIG. 6 is an enlarged isometric drawing of the novel exhaust gas diverter shown in FIG. 5.

Refer now to FIG. 6 showing an enlarged isometric drawing of the exhaust gas diverter plate 49 which has a slot 52 and a slot 53 in the horizontal flanges which permits the T-bar 29 to be maneuvered during the placement of the draft hood attachment device in its proper connection position on top of the gas conversion unit 11 during installation.

Having explained a preferred embodiment of the present invention draft hood attachment device and a modification thereof, it will be appreciated that the cover plate 31 is not a functional part of the draft hood attachment device, and that other types of holding devices which are capable of cooperating with the washer 38 may be employed to place tension in the spring 37 and connect the novel draft hood to the top of a gas conversion insert unit 11.

The draft hood shown in FIGS. 5 and 6 employ a compression spring 37 (not shown) and a control rod 35. However, the control rod 35 may be replaced with a tension spring 54 attached to the top of the draft hood 10 and fixed to a member inside of the gas conversion unit 11 and/or to the aforementioned described cover plate 31.

In the preferred embodiment shown in FIGS. 1 and 2, the adapter collar 15 has to be connected to the liner 14 before placing the draft hood 10 on top of the gas conversion unit 11. Once the draft hood is connected to the liner, it may be suspended above the top of the gas conversion unit, or just placed on the top of the gas conversion unit so that the T-bar handle 28 drops through the exhaust outlet 27 and/or is accessible to a person making the installation who reaches through the exhaust outlet 27 and grasps the T-bar handle 29. Once the T-bar handle is grasped it may be used as a lever to first position the draft hood in its proper aligned position and then tension compression spring 37 and make the connection to the gas conversion unit 11, preferably employing the cover plate 31. When a tension spring 54 is used instead of the preferred embodiment compression spring 37, the tension spring is in the hot exhaust stream where it may deteriorate over a long period of time and release the tension force which couples the draft hood 10 to the gas conversion unit 11.

Further the down draft diverter 43 serves a dual purpose in that it avoids the possibility of blowing out the gas flame with a sudden burst of down draft and also provides a means for storing the exhaust gases which have accumulated in the chimney into the plenum area surrounding the gas conversion unit. This storage permits the gas to belatedly exhaust out the chimney when the down draft pressure is relieved.

What is claimed is:

1. A draft hood device for mounting on top of a gas conversion unit in a fireplace enclosure, comprising:

a box having an exhaust inlet in the bottom and an exhaust outlet adaptor in the top, positioning means on the sides of said box for aligning and positioning said box on the top of said gas conversion unit, down draft diverter means mounted inside of said box in between said exhaust inlet and exhaust outlet, and means for connecting and aligning said draft hood device to the top of said gas conversion unit which includes spring means for applying a coupling force between said box and the top of said gas conversion unit.

2. A draft hood device as set forth in claim 1 wherein said connecting means comprises a compression spring mounted on top of said box and a connecting rod mounted through said box and through said compression spring for applying a coupling force thereto.

3. A draft hood device as set forth in claim 1 which further includes exhaust gas baffle means mounted inside of said box for diverting exhaust gases in a horizontal direction before they enter into the exhaust outlet adaptor.

4. A draft hood device as set forth in claim 3 wherein said exhaust gas baffle means comprises an L-shaped structure.

5. A draft hood device as set forth in claim 4 wherein said L-shaped structure comprises a pair of L-shaped sheet members.

6. A draft hood device as set forth in claim 1 wherein said connecting means comprises a tension spring mounted on the inside of said box.

7. A method of installing a gas conversion unit in a fireplace enclosure, comprising the steps of:

connecting a flue liner to an exhaust outlet adapter of a draft hood, supporting said draft hood to clear the top of said gas conversion unit, inserting said gas conversion unit in the fireplace enclosure, reaching through the top of the gas conversion unit from the inside and moving said draft hood unit to an aligned position on top of said gas conversion unit, and applying a spring force on said draft hood to tightly mount and couple said draft hood to the top of said gas conversion unit.

8. A method as set forth in claim 7 wherein the step of applying a spring force on said draft hood comprises the step of compressing a compression spring on the top of said draft hood with a T-bar rod.

9. A method as set forth in claim 7 wherein the step of applying a spring force on said draft hood comprises the step of tensioning a tension spring on inside of said draft hood.

* * * * *